US007699458B2

(12) United States Patent
Mabbott

(10) Patent No.: US 7,699,458 B2
(45) Date of Patent: Apr. 20, 2010

(54) PROVISION OF IMAGES ON SURFACES

(76) Inventor: Robert John Mabbott, 12 Kent Avenue, Bedford, Bedfordshire, MK42 9SJ (GB)

( * ) Notice: Subject to any disclaimer, the term of this patent is extended or adjusted under 35 U.S.C. 154(b) by 1247 days.

(21) Appl. No.: 10/542,739

(22) PCT Filed: Jan. 19, 2004

(86) PCT No.: PCT/GB2004/000217

§ 371 (c)(1),
(2), (4) Date: Jul. 18, 2005

(87) PCT Pub. No.: WO2004/065128

PCT Pub. Date: Aug. 5, 2004

(65) Prior Publication Data

US 2006/0098315 A1 May 11, 2006

(30) Foreign Application Priority Data

Jan. 17, 2003 (GB) ..... 0301091.5

(51) Int. Cl.
*B41J 2/01* (2006.01)

(52) U.S. Cl. ..... 347/101; 347/105; 359/619; 359/883

(58) Field of Classification Search ..... 347/100, 347/101, 105, 95, 96; 428/32.1, 195; 106/31.6, 106/31.27, 31.13; 523/160; 359/619, 883
See application file for complete search history.

(56) References Cited

U.S. PATENT DOCUMENTS

| | | | | |
|---|---|---|---|---|
| 3,616,192 | A * | 10/1971 | Sinclair | 428/31 |
| 5,084,309 | A * | 1/1992 | Smith et al. | 428/195.1 |
| 2004/0090507 | A1 * | 5/2004 | Mabbot | 347/103 |

FOREIGN PATENT DOCUMENTS

| | | |
|---|---|---|
| EP | 0893269 | 1/1999 |
| EP | 1266766 | 12/2002 |
| WO | WO0187643 | 11/2001 |

* cited by examiner

*Primary Examiner*—Manish S Shah
(74) *Attorney, Agent, or Firm*—Woodard, Emhardt, Moriarty, McNett & Henry LLP

(57) ABSTRACT

A method of providing a surface of a material with an image, includes applying to the surface an image sheet included (i) a flexible layer of a Shape Memory Polymer, and (ii) an image bonded to said layer by means of an image key coat. The image sheet is bonded to the surface by means of an adhesive and a process which involves heating of the Shape Memory Polymer to a temperature above its Glass Transition Temperature.

9 Claims, 1 Drawing Sheet

PROVISION OF IMAGES ON SURFACES

Figure 1:
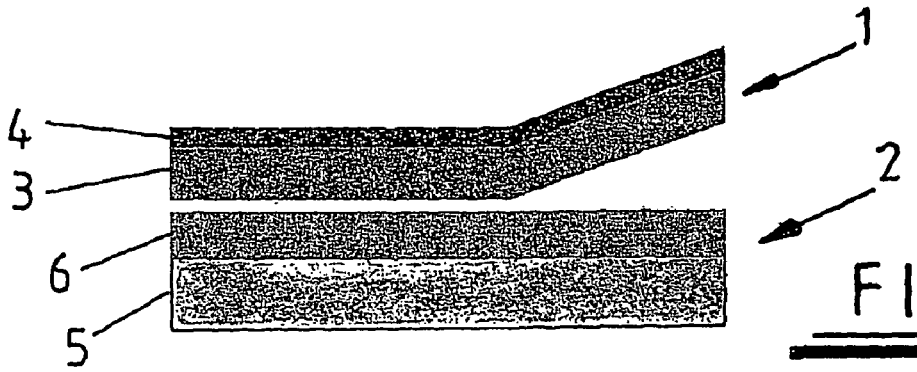

The present invention relates to the provision of images on surfaces, particularly (but not necessarily) flexible surfaces. The invention relates more particularly to an image sheet and also to the use of the image sheet for applying a marking to the surface, particularly of a flexible material such as for example leather, synthetic polymer or textile material.

The invention relates more particularly but by no means exclusively to image sheets for use in, and methods for applying images to, shoes such as fashion shoes and recreational shoes (e.g. sports and walking shoes).

Although many techniques for 'marking' (which term as used herein includes "colouring") sheets of flexible material (e.g. leather) and preformed articles are known, many suffer from disadvantages. For example, leather goes through many manual steps to make the many colours and specialist finishes that are produced either as part of a tanneries product offering or are specific to customer specification and requirements. These methods can be very labour intensive and are not always repeatable.

Furthermore the fashion industry needs to be able to respond relatively quickly to changes in taste (e.g. colouration) and/or design or markings on products and existing techniques do not always allow changes to be made rapidly. Furthermore considerable investment may have been made for a particular colouration and/or marking and the manufacturer may be loathed to make changes, in spite of the fashion trends.

WO-A-0187643 discloses a technique for applying an image to a non-planar surface using an image sheet comprised of a Shape Memory Polymer (or like material) which is a material that is able quickly to change from 'hard' to 'soft' when heated and regain original hardness quickly when cooled. When heated to the glass transition temperature ($T_g$), the SMP can easily be remoulded to take on a new shape when cooled. Once the SMP is again exposed to temperatures in excess of $T_g$, the memory effect urges the SMP to regain its original process shape). It is the existence of a large and reversible change in elastic modulus across the glass transition temperature ($T_g$) which makes shape change and shape retention possible.

The disclosure of WO-A-0187643 is concerned particularly with a transfer operation in which an image carried by the SMP is transferred to provide a marking on the non-planar (usually rigid) surface. The marking of a model racing car is specifically disclosed. More particularly, the process of WO-A-0187643 involves conforming the layer of the SMP to the actual shape of the article to be imaged and then effecting transfer of the image from the SMP layer onto the article. The release of the image from the SMP layer occurs because it was found, in accordance with the disclosure of WO-A-0187643 that the SMP had an unexpected surface release properties which enabled it to (i) serve as a carrier for the image, and (ii) release the image so as to effect the image transfer.

Reference is also made in WO-A-0187643 to a technique in which both the SMP and its image are bonded to the surface of a 3-Dimensional object, but without further detailed description.

According to a first aspect of the present invention there is provided a method of providing a surface of a material with an image, the method comprising applying to the surface an image sheet comprised of:

(i) a flexible layer of a Shape Memory Polymer (or like material), and (ii) an image bonded to said layer by means of an image key coat, and bonding said image sheet to the surface by means of an adhesive and a process which involves heating of the Shape Memory Polymer (or like material) to a temperature above its Glass Transition Temperature.

According to a second aspect of the present invention there is provided an image sheet comprised of:

(i) a flexible layer of a shape memory polymer (or like material), and (ii) an image bonded to said layer by means of an image key coat.

According to a third aspect of the present invention there is provided an image transfer assembly comprising an image sheet as defined for the second aspect of the present invention on a releasable carrier.

The term image as used in the present specification is intended to cover anything which changes the appearance of the surface being marked. The image may, for example, be a pattern comprised of individual, visually distinguishable elements. Alternatively the image may be a continuous colouration.

An "image key coat" is also referred to in the art as an "image tie coat layer" or "image tie layer".

We have found, in accordance with the invention, that the surfaces of materials (and particularly flexible materials) may conveniently and effectively be provided with an image by means of an image sheet which is comprised with a layer of Shape Memory Polymer to which is bonded the image which it is desired to apply to the surface.

Generally it will be the "image side" of the layer of shape memory polymer that is applied to the material being marked. In other words, the image is sandwiched between the SMP layer and the material that has been marked.

The image sheet (comprised of the Shape Memory Polymer and image) has particular advantages when used for providing an image on a flexible surface. These advantages result from the application process (in accordance with the first aspect of the invention) in which the image sheet is applied to the surface in a process which involves heating the SMP to a temperature above its glass transition temperature. As a result of the properties of SMP, the image sheet may be applied to a surface with a degree of force (which in certain circumstances may be relatively light and be provided by "brushing with the hand") so that the SMP layer unites, and effectively becomes "as one", with the surface being marked and able to flex therewith. Delamination of the SMP layer and the image is prevented by virtue of the latter being bonded to the former by means of the image key coat and any additional intermediate layers.

Heating of the SMP above its glass transition temperature may be effected in a number of ways, depending for example on the degree of temperature elevation required to reach the glass transition temperature. If the temperature elevation required is relatively low (say a few degrees Celsius) then brushing over the SMP layer with the hand can be used to provide the necessary heating.

The surface being marked may be one having a degree of surface texture or "microtexture". Examples of such surfaces include leather (the texture being provided by the 'porous' nature of the surface) and textile fabrics (e.g. canvas) for which the texture is provided by the overall fibrous make-up of the material. For such textured materials, the SMP layer becomes not only bonded to the surface but can be such as to be able faithfully to reproduce the surface texture. It is also possible to provide a surface with a texture (e.g. by use of a hardenable paste composition) which it is desired to reproduce in the applied image.

More particularly, with the SMP above its glass transition temperature, use of a degree of force causes the SMP to adopt the texture of the surface to which it is being applied. Loading of the SMP layer to below its glass transition temperature causes the texture to be retained in the SW layer. Retention of the texture in the SMP layer is further enhanced by virtue of the fact that the SMP layer is bonded to the substrate by an adhesive (thus "resisting" any tendency for the SMP layer to revert to a "flat", non-textured form).

The SMP layer may for example have a thickness of 4 to 200 microns but more preferably 20 to 60 microns. The actual thickness of the SMP layer employed will usually depend on the characteristics of the flexible material whereof the surface is to be marked. For example, if this material is a textile fabric then the thickness of the SMP layer (and for that matter the overall thickness of the image sheet) can be such as to maintain the handle (e.g. drape characteristics) of the fabric.

Examples of flexible materials that may be provided with images in accordance with the method of the first aspect of the invention include leather, textiles and synthetic plastics materials. The method may be applied for applying an image to a flat sheet of such a material or to such a material already in a pre-formed shape. Thus, for example, the method may be used for the application of images to planar or 3-Dimensional surfaces of shoes, which may for example be parts fashion shoes or sports shoes (e.g. walking shoes). Thus the image may be applied to a flat panel or around the toe-cap of such a shoe.

It is generally preferred that the SMP has a $T_g$ value of 25-40° C. Values in this range will generally ensure the required flexibility for the SMP with lower values in the range providing improved flexibility. Suitable materials are available under the Trade Mark DIAPLEX.

As indicated above, the image sheet comprises the SMP layer to which is bonded an image by means of an image key coat. Generally a "pre-image" assembly will be prepared comprised of the SMP layer having the image key coat on one surface thereof. This image key coat may for example be in the form of an adhesive or an adhesion promoter. Depending on the printing technique used for laying down the image, an adhesive or adhesion promoter used as the image key coat may provide a surface that is sufficiently receptive for the ink. However for certain other types of ink, it may be necessary to provide an additional ink receptive layer that is bonded to the adhesive or adhesion promoter that provides an image key coat, the image then being printed onto that ink receptive layer.

Xerographic and ElectroInk images may generally be laid directly onto an image key coat which is in the form of an adhesive or adhesion promoter. However in the case of an ink jet image it will generally be necessary to apply a so-called "ink jet coating" to such an adhesive or adhesion promoter layer (provided as the image key coat) before printing with the ink jet. Such "inkjet coatings" layers are well known in the art. A further possibility is to treat the surface of the SMP layer with a corona discharge and apply the "ink jet coating" to the corona treated surface.

A suitable material for providing the image key coat for xerographic images is a polyamide (such as Lioseal V7036—ex Henkel) applied as a solution in isopropyl alcohol. The image is adhesively bonded (either directly or indirectly) to the SMP layer. The adhesive bonding may be by means of an adhesion promoter which may for example be provided by a polyamide (such as lioseal V7036—ex Henkel) applied as a solution in iso-propyl alcohol.

The image is most preferably generated by, and printed under control of, computer software. Obviously a vast range of images may be printed under software control. The image may be one which has been printed using an ink jet printed or laid down by a printing technique involving use of a toner, e.g. by means of a Dry Toner Printer.

An image transfer assembly in accordance with the third aspect of the invention comprises the image transfer sheet on a releasable carrier. The releasable carrier most preferably comprises paper (particularly one having a basis weight of 80-150 gsm, more preferably 80-100 gsm) provided with a release surface. Most preferably the release surface is one which softens and/or releases at a temperature less than the $T_g$ of the SMP, most preferably with a release force of 18-42 dynes per sq cm. The release surface may for example be of polypropylene, polyethylene, polyester, wax or, particularly preferably, TPX (polymethyl-4-pentene).

It is also possible to release from the carrier (with the SMP layer) a release material (e.g. TPX) which is on the surface of the SMP layer remote from the image. Such a release material on the SMP surface will assist in preventing that surface of the SMP sticking to itself once the carrier has been removed.

A further preferred release carrier is Orientated Polypropylene (OPP) with a peel force (PL) in the range of 120-180 gsm (preferably about 150 gsm)-50 mm.

The method of applying the image sheet (comprised of SMP layer and image bonding thereto) to the surface requires the use of an adhesive. This may be provided on that surface of the image sheet which is to be applied to the article being marked. Alternatively or additionally the adhesive may be provided on the surface itself. In all cases, the adhesive may be heat and/or pressure activated it is particularly preferred that the adhesive is a pressure sensitive adhesive. This allows the image sheet to be applied to the surface and if necessary removed until it is in the correct position. The adhesive may be one which can be subsequently cross-linked (e.g. by heat or uv-curing) so that the image sheet will remain permanently in place. The adhesive may be one that is heat activated a few degrees (e.g. 2-3° C.) lower than the $T_g$ value of the SMP layer. The adhesive may for example be an air-dried polyurethane adhesive which may be applied by coating, spraying or brushing. Generally the adhesive will be applied in an amount of 0.05 to 4.0 grams per square meter dry weight. An example of a suitable adhesive is an aqueous dispersion of an aliphatic polyester-polyurethane without free isocyanate groups, e.g. as available under the tradename 7461 Alberdingk Boley of Krefeld, Germany. Such an adhesive may be used to prime the imaged SMP and also the surface (e.g. leather or cotton canvas) on which the image is to be provided.

The image sheet is applied to the surface (on which the image is to be formed) using heat and (usually) a degree of force (which may be relatively light). The heat employed is sufficient to raise the temperature of the SMP above its $T_g$ value. The heat may, for example, be a device blowing hot air. Depending on the $T_g$ value of the SMP, heat from the hand may be sufficient. The force may be applied, for example, by a pressure roller or by drawing the image sheet under vacuum against the surface to be marked. Alternatively the force may be by means of brushing by hand. Alternatively, depending on the $T_g$ value of the SMP, the force may be applied by strokes of the hand on the SMP layer. This is particularly convenient when the SMP may be raised above its $T_g$ value by heat from the hand such that stroking with the hand simultaneously provides the necessary heating and force. With the application of force, the SMP layer above its $T_g$ value generally adapts itself to the surface (and characteristics thereof, e.g. texture) being imaged. Such adaptation is retained on cooling below the $T_g$ value, and adhesive bonding of the image to the substrate enhances retention of the adaptation. It should however be the case that the $T_g$ value and Elastic Modulus of the SMP polymer is selected having regard to the nature of the surface being marked. Generally the $T_g$ value will be in the range 25° to 40° C., but lower values in this range will have greater elasticity (when above their glass transition temperatures). Therefore when, say, applying an image to canvas, using light brushing with the hand, the use of an SMP layer with a low glass transition temperature will ensure not only that the SMP layer can be manipulated to cover the surface being marked but also that the SMP polymer will be able to adopt the "microtexture" of the surface. This latter feature may not be possible if the $T_g$ value and/or the Elastic Modulus of the SMP layer is too high. By way of example, SMP with a $T_g$ of 25° C. and an Elastic Modulus of 3.0 Mpa provides an elastic film that may be difficult to form to a surface with very high peaks using "hand pressure". In such circumstances, it may be preferred that the Elastic Modulus is in the range 1.4-3.0 Mpa.

On cooling, the film will endeavour to retain its new form and is held in place by means of the adhesive allowing the film to reproduce the characteristics of the surface to which it has been applied.

It will be appreciated that the releasable carrier may be removed at some stage during the application process, e.g. by peeling away from the (applied) image sheet whilst pressure is still applied ahead of the 'peel front'.

The adhesive that is used for bonding the image sheet to the surface being imaged may be one which is such that the image sheet may be removed by heating. This provides for the possibility of providing an article with different images, as desired. For example, if the article is a fashion shoe, then the applied image may be changed to suit circumstances (e.g. a current fashion trend, colour of other accessories worn etc).

If it should ultimately transpire that the image as applied to a surface particularly a flexible surface such as leather) needs "freshening-up" in that wrinkles or other surface imperfections appear in the image then the application of heat to the surface (optionally with light hand brushing) will generally be sufficient to reestablish the original appearance.

It should be appreciated that the invention may adopt a number of forms. For example, the image sheets (comprised of the SMP layer and image), generally on a releasable carrier, may be manufactured and sold to an end user. This end user may for example be a manufacturer of articles (e.g. shoes) which are provided with an image (in accordance with the invention) prior to sale to the public. Alternatively the image sheets may be supplied for home use by a person who wishes to 'personalise' their possessions.

The image sheets may be supplied without application thereto of the adhesive that is to be used for bonding the sheet to the surface being marked. It is possible for an end user to apply additional design to the surface of the image prior to application. Such enhancement of the image may be provided by "under painting", "texturising" or "foiling".

Under-painting is a technique generally used when the target substrate is a dark colour and the image is required to both merge with the substrate and be visible through opacity. Under-painting is usually applied by a paint brush or air brush.

Texturising is a technique that is mostly used when the substrate, to which the image sheet is to be applied, is relatively flat. A texturising medium based, for example, on an air-drying acrylic paste.

Foiling is a technique generally involving the use of a hot roller laminator and cause for a pre-adhesion coat of adhesion promoter before it can be applied. The foiling technique can be either blanket or selective.

It is also possible, in accordance with the invention, to supply, to an end user, a 'pre-image' assembly comprised of a releasable carrier on which is provided an SMP layer with an image key coat to which an image is ultimately bonded. Depending on the way in which the image is to be printed, the "pre-image" assembly may also incorporate an extra layer (bonded to the image key coat) provided with an ink receptive surface, e.g. for the case where the image is to be printed by means of an ink jet printer. The purchaser of such a 'pre-image' assembly may then apply an image of their choice (e.g. using an ink-jet printer) to produce an image sheet in accordance with the invention. Such an image may, for example, be one contained within a software package or one downloaded from the internet. The image sheet may then be adhesively bonded to a surface in accordance with the above described procedures.

The concepts outlined in the previous paragraph may be embodied, for example, in a kit such as an "art kit" supplied to a user. Such a kit may comprise the pre-image sheet, adhesive and a material to which the (ultimately formed) image sheet is applied. The kit may, for example, be one intended for producing a picture for hanging on a wall or the like. The material which is provided in the kit and to which the image sheet is to be applied may, for example, be canvas or similar material. The user may print onto the 'pre-image' sheet a picture of their choice and then apply the resulting image sheet to the canvas (using the techniques described more fully above) using an adhesive to bond the sheet to the canvas. The adhesive may be applied to the image or the canvas. The adhesive may for example be a pressure sensitive adhesive provided, in the kit, in the form of a layer sandwiched between two release sheets. One of the release sheets is removed to allow the application of one face of the adhesive layer to the image. The other release sheet is then removed to allow the other face of the adhesive layer to be used to bond the image to the canvas.

A number of variations for the kit described in the previous paragraph are possible. In a first such variation, the image applied to the SMP layer is an outline or "ghost" image rather than the final picture. In this case, the SMP layer carrying the outline image may be bonded to the canvas in exactly the same way as described in the previous paragraph. The exposed face of the SMP layer may now be "painted" (e.g. using paints provided with the kit) to produce the final picture. Thus, in this case, application of the SMP layer (with its outline image) to the canvas provides a textured surface marked with an image which the user can then "paint" using his/her own colour shades, types of brushstroke etc to produce the final picture.

A further possibility is for a user of the kit to be able to "build-up" on the canvas the required texture for a final printed image to be applied to the canvas. In this case, an SMP layer provided with an outline image may be applied and bonded to a canvas layer in the same way as described in the previous paragraph. Subsequently, the user will apply a hardenable texturing material (e.g. an air-hardenable material such as an air-hardenable acrylic paste) to the outline image to provide a desired texture, e.g. to simulate brushstrokes. Subsequently, a further layer of SMP carrying the final, coloured form of the image is then bonded to the canvas over the hardened texturing material and in register with the underlying image. The bonding of this (second) SMP layer to the canvas is carried out exactly as described previously (using adhesive and ensuring that the SMP is subjected to a temperature above its $T_g$ value). The end result simulates an oil painting by virtue of the texturing of the final SMP layer which in turn carries a printed form of the full image (with all colouration, detail etc).

A further example of kit in accordance with the invention is a package which comprises a pair of shoes, a pre-image sheet (on which a purchaser of the kit may print a desired image, possibly from software supplied with the kit), and an adhesive for bonding the pre-image sheet in position. Such a kit may be such that the pre-image sheet (when printed) is applied to the shoes. Alternatively the kit may also comprise removable covers for the shoes and the pre-image sheet (when printed) is to be applied to those removable covers.

Figure 2:
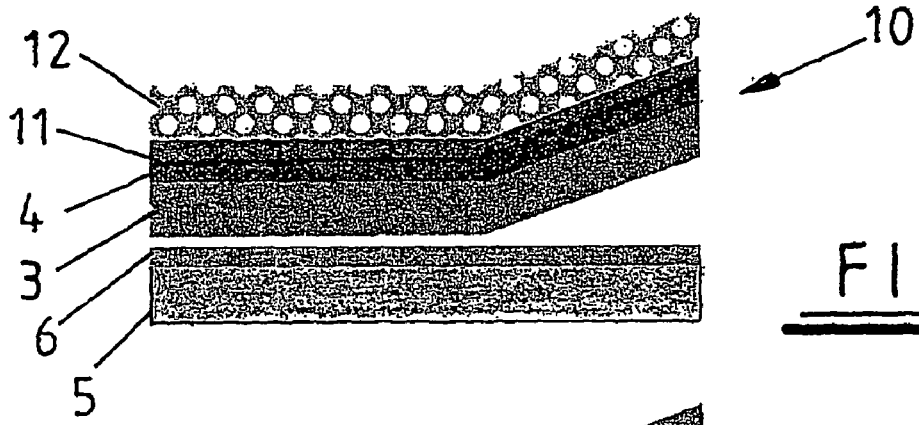
Figure 3:
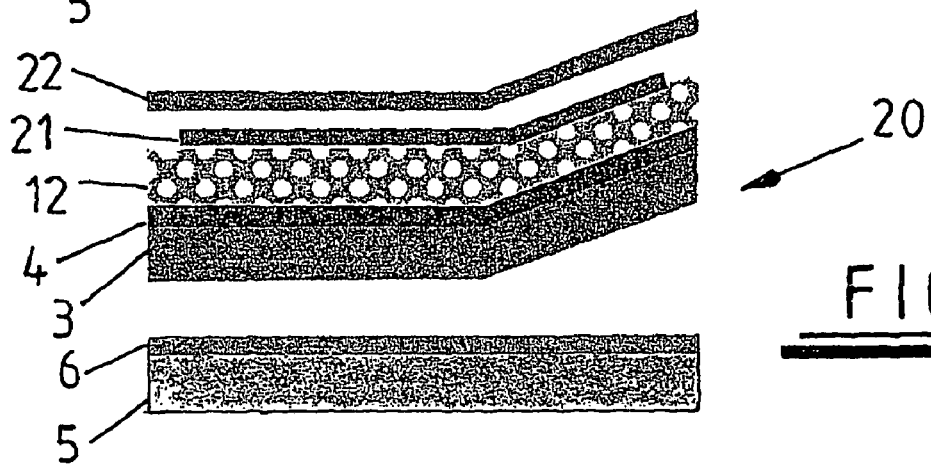

The invention will be further described, by way of example only, with reference to FIGS. 1-3 of the accompanying drawings which illustrate various embodiments of the invention.

FIG. 1 illustrates a 'pre-image' assembly 1 provided on a release system 2. The pre-image assembly 1 comprises an SMP layer 3 on which is provided an image key coat 4 to which an image (not shown in FIG. 1) is intended to be applied. The release system 2 comprises a paper carrier 5 laminated to a release layer 6, the latter being in face-to-face contact with the SMP layer 3.

Reference is now made to FIG. 2 which illustrates an embodiment of image sheet 10 in accordance with the invention (like parts in FIGS. 1 and 2 are depicted by the same reference numerals and are not all therefore described further). The image sheet assembly 10 shown in FIG. 2 incorporates an image receptor layer 11 applied to the image key coat 4. Applied to the image receptor layer 11 is an image 12, e.g. produced by means of an ink jet printer (not shown).

The image sheet 10 illustrated in FIG. 2 may be applied to a surface using the techniques described more fully above.

Reference is now made to FIG. 3 which illustrates an alternative embodiment of image sheet assembly 20 in accordance with the invention, (like parts in FIGS. 2 and 3 are depicted by the same reference numerals so therefore are not all described further). In the image sheet 20 of FIG. 3, the image layer 12 is one that has been laid directly onto the image key coat 4. This will generally be possible in the case of a Xerographic or ElectroInk image. Additionally a pre-application enhancement layer 21 (e.g. 'under-painting', 'foiling' or 'texturing') has been applied to the image layer 12. Additionally FIG. 3 shows an adhesion promotion layer 22 which is used for bonding the image sheet to a surface.

The invention claimed is:

1. A method of providing a surface of a material with an image, the method comprising applying to the surface an image sheet comprised of (i) a flexible layer of a Shape Memory Polymer, and (ii) an image bonded to said layer by means of an image key coat, and bonding said image sheet to the surface by means of an adhesive and a process which involves heating of the Shape Memory Polymer to a temperature above its Glass Transition Temperature.

2. A method as claimed in claim 1 wherein the material is flexible.

3. A method as claimed in claim 1 wherein the material is leather, a textile material or a synthetic plastics material.

4. A method as claimed in claim 3 wherein the material is leather.

5. A method as claimed in claim 1 wherein the Shape Memory Polymer has a $T_g$ value of 25-45° C.

6. A method as claimed in claim 1 wherein the Shape Memory Polymer layer has a thickness of 20 to 60 microns.

7. A method as claimed in claim 1 wherein the image key coat comprises an adhesive or an adhesion promoter.

8. A method as claimed in claim 7 wherein an ink receptive layer is provided between the image and the layer of the adhesive or adhesion promoter providing the image key coat.

9. A method as claimed in claim 1 wherein the adhesive for bonding the image sheet to the material is a heat activated adhesive which is activated at a temperature 2-3° lower than the Glass Transition Temperature of the Shape Memory Polymer layer.

* * * * *